US005979145A

United States Patent [19]

Louis et al.

[11] Patent Number: 5,979,145

[45] Date of Patent: Nov. 9, 1999

[54] METHOD AND DEVICE FOR COMPRESSING AND PACKAGING COMPRESSIBLE PRODUCTS

[75] Inventors: Bernard Louis, Liancourt; Bernard Bichot, Clermont, both of France

[73] Assignee: Isover Saint-Gobain, Courbevoie, France

[21] Appl. No.: 08/952,071

[22] PCT Filed: May 9, 1996

[86] PCT No.: PCT/FR96/00693

§ 371 Date: Nov. 17, 1997

§ 102(e) Date: Nov. 17, 1997

[87] PCT Pub. No.: WO96/36536

PCT Pub. Date: Nov. 21, 1996

[30] Foreign Application Priority Data

May 15, 1995 [FR] France ..... 95 05712

[51] Int. Cl.[6] ..... B65B 63/02

[52] U.S. Cl. ..... 53/439; 53/436; 53/450; 53/553; 53/526; 53/528; 53/529; 100/151; 100/178

[58] Field of Search ..... 100/151, 177, 100/178, 222; 53/436, 439, 526, 528, 529, 530, 450, 553

[56] References Cited

U.S. PATENT DOCUMENTS

| | | | |
|---|---|---|---|
| 1,758,970 | 5/1930 | Pohjonen | 100/178 X |
| 2,567,052 | 9/1951 | Carruthers | 53/438 X |
| 2,913,863 | 11/1959 | Sylvester et al. | 53/526 X |
| 2,960,023 | 11/1960 | Greiner et al. . | |
| 2,987,987 | 6/1961 | Raney et al. | 100/178 X |
| 3,132,607 | 5/1964 | Hinckle | 53/435 X |
| 3,138,906 | 6/1964 | Anderson | 53/526 |
| 3,291,678 | 12/1966 | Enloe et al. | 53/436 X |
| 3,323,273 | 6/1967 | Lee et al. | 53/436 |
| 3,645,198 | 2/1972 | Field | 100/151 X |
| 3,676,265 | 7/1972 | Edwards | 100/151 X |
| 3,710,536 | 1/1973 | Lee et al. | 53/526 X |
| 3,717,973 | 2/1973 | Brady | 53/530 |
| 3,723,230 | 3/1973 | Troutner | 100/151 X |
| 3,837,138 | 9/1974 | Terry | 53/439 |
| 3,878,027 | 4/1975 | Troutner | 100/151 X |
| 3,883,284 | 5/1975 | De Mets | 100/151 X |
| 3,883,285 | 5/1975 | De Mets | 100/151 X |
| 3,907,473 | 9/1975 | De Mets | 100/151 X |
| 3,932,983 | 1/1976 | Hughes . | |
| 4,101,370 | 7/1978 | Russell | 100/151 X |
| 4,377,061 | 3/1983 | Olson et al. . | |
| 4,688,372 | 8/1987 | Langen et al. | 100/151 X |
| 4,762,061 | 8/1988 | Watanabe et al. | 100/178 X |
| 4,909,388 | 3/1990 | Watanabe | 206/410 |
| 5,421,951 | 6/1995 | Troutner et al. | 100/151 X |
| 5,425,512 | 6/1995 | Bichot et al. . | |
| 5,501,064 | 3/1996 | Ingram et al. | 53/543 X |

FOREIGN PATENT DOCUMENTS

| | | |
|---|---|---|
| 085349 | 8/1983 | European Pat. Off. . |
| 2123313 | 9/1972 | France . |
| 2546478 | 11/1984 | France . |

*Primary Examiner*—Daniel B. Moon

*Attorney, Agent, or Firm*—Oblon, Spivak, McClelland, Maier & Neustadt, P.C.

[57] ABSTRACT

A method and apparatus for compressing and packaging compressible materials. The compression is carried out continuously between parallel plates which come closer to each other as they advance. As the plates advance, the materials are accompanied by a lower packaging film and an upper packaging film which are joined at the sides of the compressed materials at the end of compression.

17 Claims, 6 Drawing Sheets

METHOD AND DEVICE FOR COMPRESSING AND PACKAGING COMPRESSIBLE PRODUCTS

BACKGROUND OF THE INVENTION

1. Field of the Invention

The invention relates to the techniques of compressing and packaging compressible materials such as, in particular, sets of mineral fibre panels.

2. Discussion of the Background

In order to transport and store at reduced cost products which are bulky but compressible and capable of recovering their volume and all their original characteristics after they have been released, it is necessary to provide suitably adapted techniques and machines. They should make it possible to obtain effective compression and quality packaging rapidly and automatically while preserving the characteristics of the products in question.

DESCRIPTION OF THE RELATED ART

U.S. Pat. No. 4,501,107 describes a machine intended to stack mineral wool mats then compress them to introduce them, in the compressed state, into a type of bag which constitutes the packaging of the product. They remain therein during transport and storage until they arrive on the work site where the mats are released by cutting the wrapping and return to their original thickness.

This document U.S. Pat. No. 4,501,107 provides automatic means for joining the mats in a stack, for compressing the stack then for introducing the compressed stack into a bag where it remains in the compressed state. The compression means is a plate placed on the top of the stack and driven in a downward vertical movement by virtue of a piston, whereas, for its part, the plate on which the stack rests is stationary.

The method described in this document is effective but has the drawback of any discontinuous method, namely that of the dead times which separate the end of one bagging operation from the start of the following operation. Furthermore, the compressed stack cannot be introduced into the bag without employing accessories (essentially two plates, below and above the stack) for maintaining the pressure during introduction, which accessories occupy non-negligible space in the package and which consequently allow a high degree of decompression when they are removed. Furthermore, since introduction into the bags takes place by backward pushing, there is friction on the edges of the compressed stack between the fixed metal plates and a risk of damage to the panels.

For its part, U.S. Pat. No. 3,717,973 describes a machine for continuously compressing volumes of compressible products, in particular rolls of mineral wool, in order to introduce them in parallelepipedal shape into a sheath of larger dimensions in which they remain in the compressed state (but to a lesser extent than when they were introduced). The device described includes, at the lower part, a substantially horizontal conveyor belt and, at the upper part, a synchronous conveyor which is in two successive plane parts, the first convergent relative to the lower belt and the second which is substantially parallel to it. At the exit of this second region, two new horizontal conveyor belts cause the product which they have kept compressed to penetrate into the package in the form of a sheath.

Although the compression operation is carried out continuously, end-of-line packaging is an operation which, for its part, is discontinuous and requires the intervention of an operator. Furthermore, as in the discontinuous method of U.S. Pat. No. 4,501,107, the highest degree of compression which was obtained at the end of the compression operation is not conserved in the package, because, in this case also, the conveyor belts which penetrated the sheath must be extracted therefrom at the end of the operation.

Document DE-A-26 01 590 describes a method for packaging elongated packets consisting, in particular, of rolls of fabric. The process is continuous; while the packets placed along a conveyor are moved by it, a packaging film whose width is such that it can surround the packet by itself is arranged above. The conveyor is in two parts, each supporting one side of the packet. A welding device is arranged between and below the two parts and makes it possible to form a sheath around the packet.

Document DE-A-26 01 590 also provides that a suitable device between two successive packets can weld the packaging sheets and cut them to individualize the packets.

SUMMARY OF THE INVENTION

The object of the invention is to provide a process which permits effective continuous compression of volumes of compressible products, in particular stacks of mineral wool mat.

In order to achieve this object, the invention provides a process for packaging a volume of compressible material, in which the volume is placed between two pressing surfaces and transported laterally relative to the pressing direction, while the surfaces move towards one another, and in which the surfaces are parallel planes.

This arrangement makes it possible to avoid shear-stressing of the volume while it is being compressed. The known technique of continuous compression during transport of the product, such as, for example, that in U.S. Pat. No. 3,717,973, actually compresses the front of the volume more than the rear, which causes a shear stress which is detrimental for the product. In the case of mineral wool mats, in particular, this technique would lead to fractures of fibres, which would have the result that the product would never completely regain its original elasticity after the compression has been released.

The technique should also permit rapid action which does not damage the elastic properties of the material.

The invention provides that the pressing surfaces are those of plates drawn by carriages associated in pairs, and that each of the carriages is associated with a carriage which precedes it and with another which follows it, in order to constitute two trains driven at a constant speed.

Preferably, the pressing surfaces move towards each other symmetrically relative to the volume of compressible material.

Unexpectedly, the fact that a symmetrical force is exerted on the volume to be compressed makes it possible to work more rapidly and to do so by exerting smaller forces.

Of course, at the end of pressing, the volume of compressed material is wrapped in a sheath which limits its expansion, but, since a further object of the invention is to keep the packaged compressed product at the minimum volume which it reached during its compression, the process of the invention provides that the sheath consists of two bands of a packaging film placed above and below the volume of material, that they are moved with it, that their width allows them to overlap on the sides of the compressed volume and that they are joined to one another on the said sides of the volume. Preferably, the packaging film is a plastic film, the bands are joined by welding without changing plane and, after assembly, the weld is subjected to a shear stress.

This technique of in situ formation of the sheath, directly on the volumes of materials, at the moment when the compression is at a maximum, guarantees that the volume of the product when packaged will not change.

In order to implement the process, the invention provides a device including two convergent conveyors located one above the other and driven at a constant speed; they include carriages supporting plane plates, parallel to a single plane, which they move, the plates of one conveyor and the other being superposed. Preferably, the corresponding plane plates on one conveyor and on the other are symmetrical relative to a plane which is parallel to them.

In order to form the sheath, the device of the invention includes, associated with each conveyor, a dispenser of a band of plastic film arranged so as to bring one band into contact with the plate of the first lower carriage and another into contact with that of the first upper carriage; moreover the bands of plastic film have a width allowing them to be superposed on the sides of the volumes of compressed material. Preferably, the convergent conveyors include, downstream, a region where the separation between corresponding plates is substantially invariant. The device includes, in particular in this region, shaping elements intended to place the edges of the superposed bands of plastic film flat on the sides of the volumes of compressed material as well as, downstream of the shaper elements, means for welding the edges of the bands of plastic film, such as hot-air nozzles.

Thus, the device makes it possible to block the compressible object at its minimum volume, which it can almost completely retain during its transport and storage. The possibility of extension will only be encountered when the plastic film sheath is cut on the work site. Furthermore, at this moment, by virtue of the original compression technique of the invention, it will return to its initial volume and, in particular, regain all its elasticity.

BRIEF DESCRIPTION OF THE DRAWINGS

The description and the figures will make it possible to understand the invention and to perceive its advantages. In the figures.

DETAILED DESCRIPTION OF THE PREFERRED EMBODIMENTS

Figure 1:
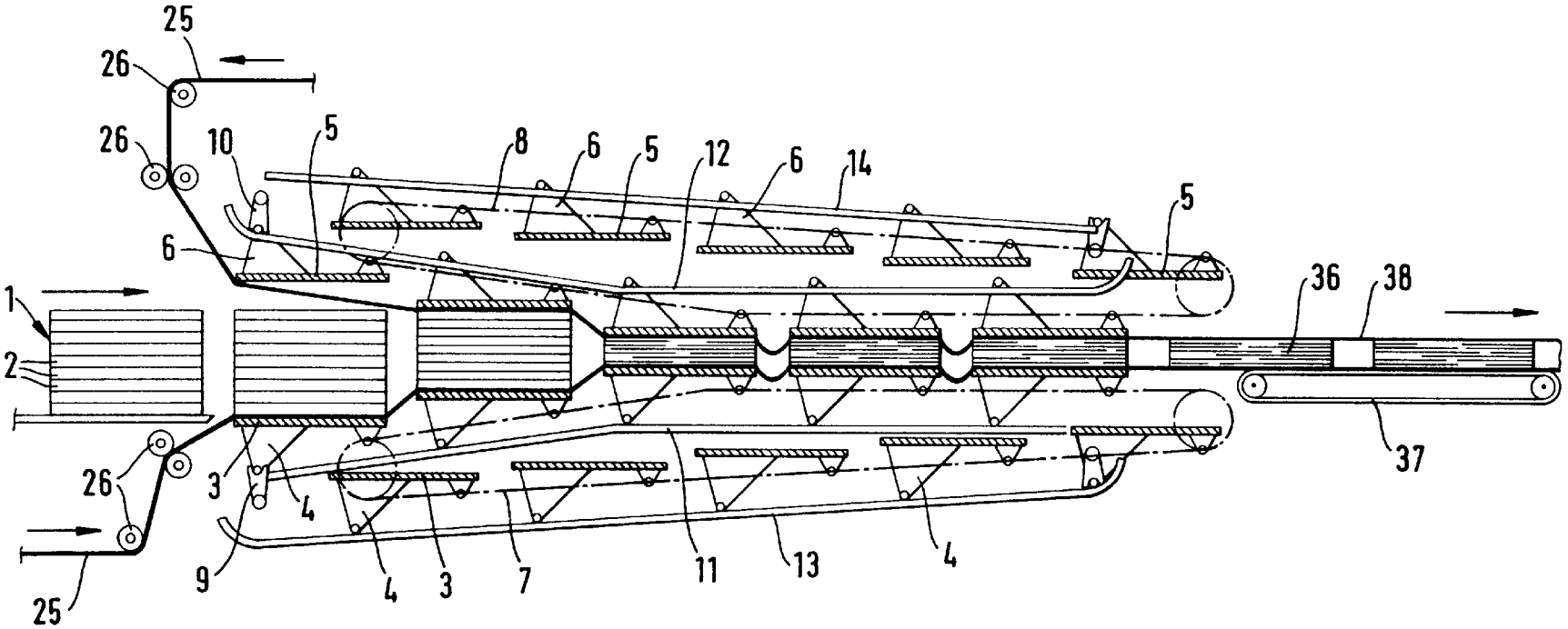
FIG. 1 shows an overall view of a machine according to the invention.

FIG. 1 represents a line for packaging volumes of a compressible material, in this case a stack 1 of panels 2 of mineral fibres, of which there are 8 in this case. The purpose is to compress this stack and package it without it expanding.

When it arrives at the entry of the machine, the stack is arranged on a horizontal platen made of a plate 3. Preferably, the plate is rectangular, like the panels, and the stack is centred on the plate. It will remain on this plate 3 until it leaves the packaging line.

The compression operation on its own, then the packaging operation will successively be described hereafter.

The plate 3 is supported, like the other nine lower plates and like the 10 upper plates represented, by a carriage 4. In fact, below the stack 1 there is another plate 5, identical and parallel to the plate 3 and supported like it by a carriage 6. The two carriages 4, 6 advance synchronously while moving towards each other. They are each driven by a chain 7, 8 (or two chains, one on each side of the carriage). The five lower carriages and the five upper carriages involved in pressing the volume 1 constitute a train which advances regularly, driven by the chains 7, 8.

During the compression operation, the carriages 4, 6 are drawn by the chains 7, 8 to which they are joined by spindles, each passing through the hollow in one link of the chain, while a smooth roller centred on the spindle makes it possible to guide the chain. At the rear of the carriage, guide means are provided on each side, in the form of rollers 9, 10 which follow a guide 11, 12 (a rail). The paths followed by the chains 7, 8 and by the guides 11, 12 are such that, when the carriages 4, 6 progress, the plates 3, 5 remain substantially horizontal while progressing towards each other. It is, however, possible for the plates 3, 5 to be inclined relative to the horizontal, for one reason or another. What is important is that they are always as parallel as possible and no sliding occurs between the plates and the material which they compress.

The figure represents a straight trajectory of the chains 7, 8, as for the rear rollers of the carriages 9, 10, but it may be advantageous to have a slope which differs depending on the phases in the compression process.

At the end of compression (which relates in the figure to two carriages at the bottom and two at the top) the compressed material is transported without changing volume.

At the end of the packaging line, the carriages are extracted from the trajectory which they followed during the compression and start off again in the other direction, pushed by the chains and guided by a second guide path 13, below the guides 11 and 14 above the guide 12.

In order to change from one guide path 11, 12 to another 13, 14, it is necessary to operate the switching points. FIG. 2 represents the upstream switching point and FIG. 3 represents the downstream switching point (the those [sic] cases relate to the lower carriage, the devices for the upper carriages are equivalent).

Figure 2A:
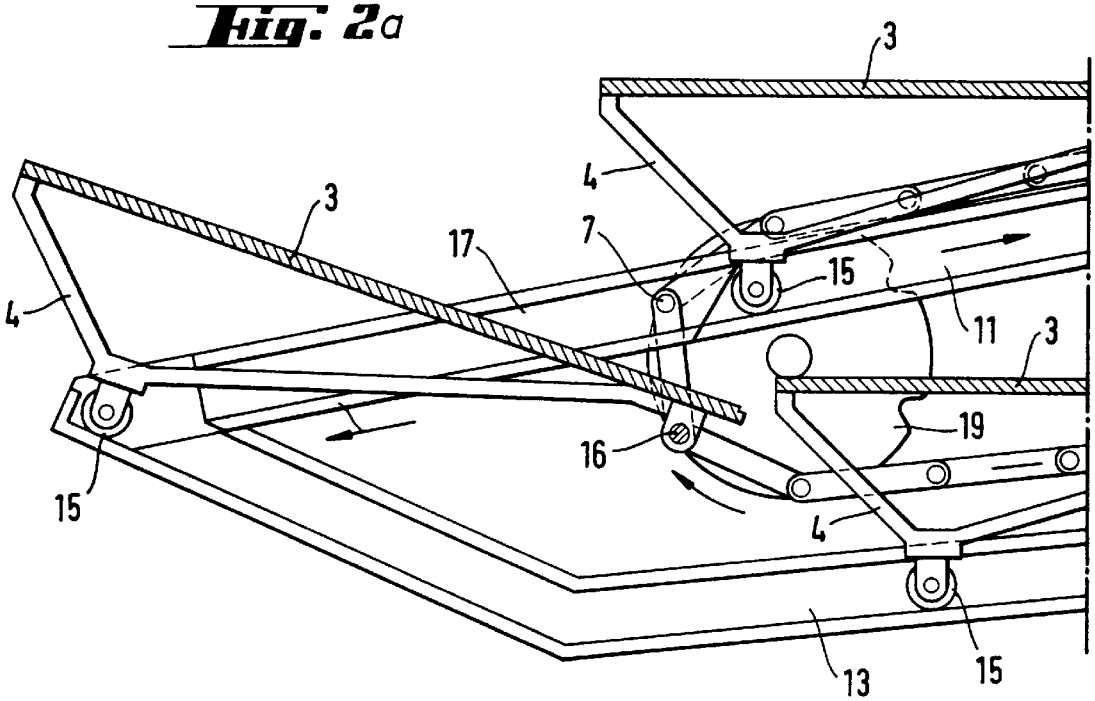
FIGS. 2*a* and 2*b* represent the upstream end of the machine when a new carriage is introduced into the circuit.
Figure 2B:
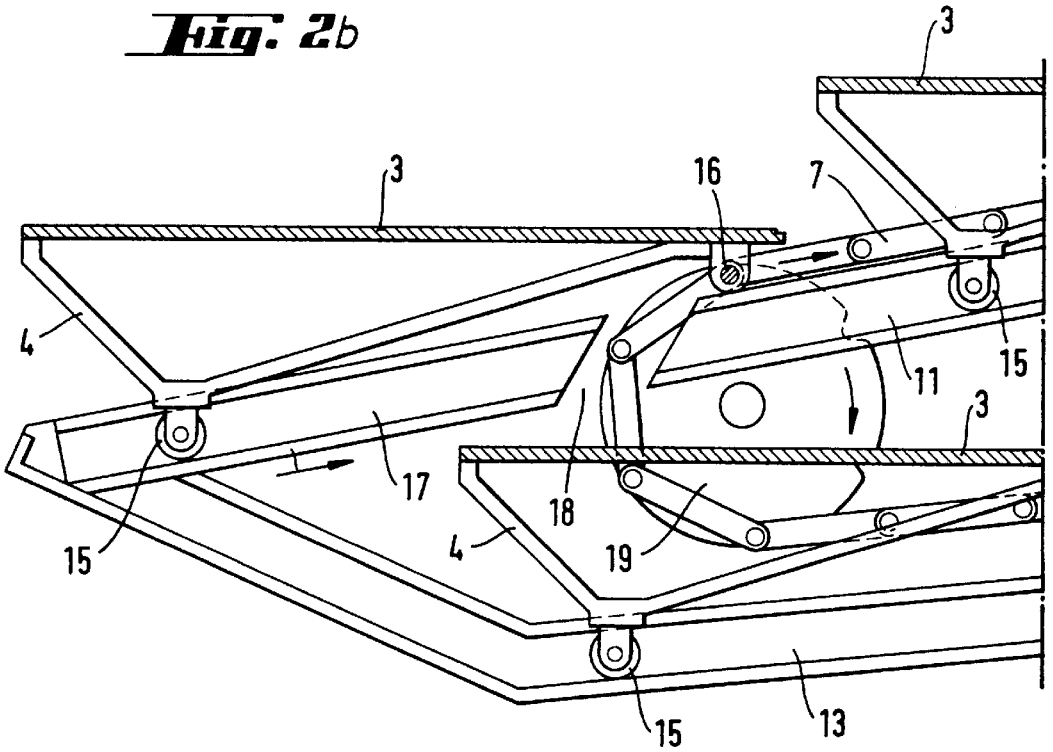

In FIG. 2*a*, the roller 15 has to leave the lower guide part 13 to rejoin the upper guide part 11 before commencing the compression operation. At the other end of the carriage, the spindle 16 connected to the carriage is driven by the link of the chain 7 through which it passes.

Between the lower guide part 13 and the upper guide part 11 there is a mobile guide element 17. It is capable of sliding laterally in extension of the upper guide part 11. When the carriage arrives (FIG. 2*a*), it is in the position towards the right, but when the carriage leaves again (FIG. 2*b*) it is situated in abutment on the left. It will again move towards the right during the progression of the carriage, so that, when the roller 15 arrives in the connection region 18, the mobile guide 17 is in place there in order to avoid any discontinuity.

The mobile guide 17 may be displaced by a jack controlled by a central computer tasked with controlling the entire packaging line. It is, however, preferable to have "positive" drive of the mobile guide element 17 by the gearwheel 19 which drives and/or supports the chain 7. This mechanical link is produced by a crank-rod system, not represented.

Figure 3A:
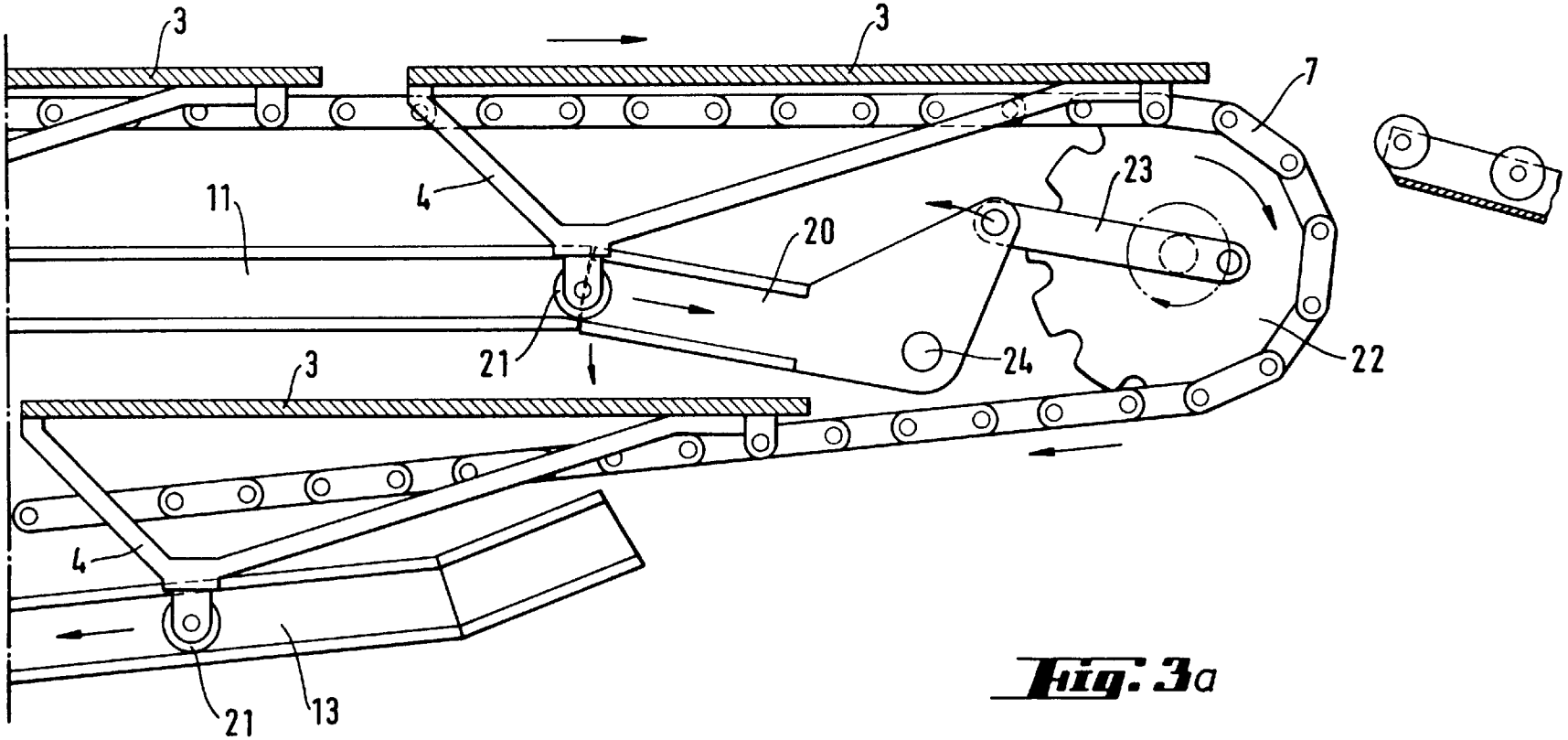
FIGS. 3*a* and 3*b* show, at the downstream end, the exit of a carriage from the circuit.
Figure 3B:
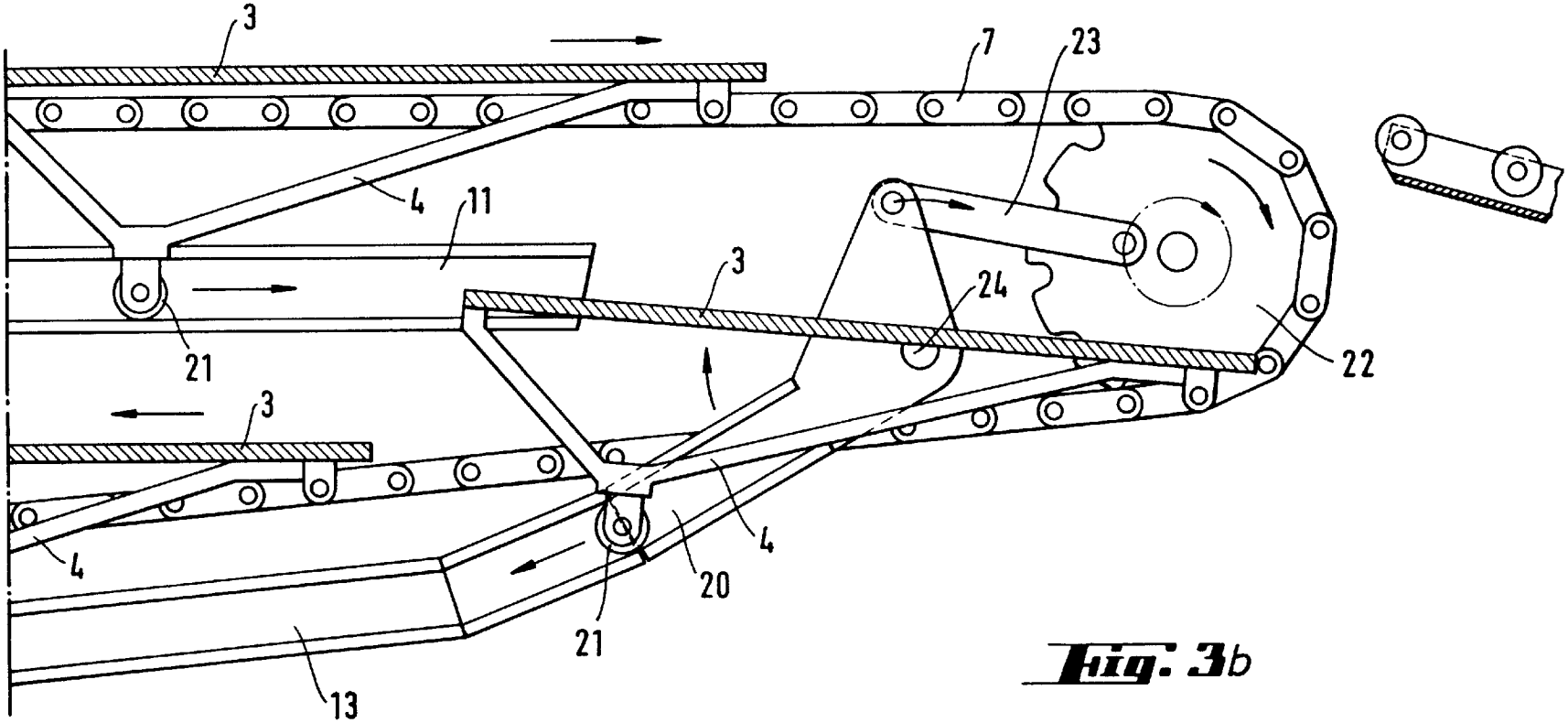

In FIG. 3, the system is different because the mobile guide element 20 is displaced while moving with it the roller 21 which thus passes almost instantaneously from the upper guide part 11 to the (return) lower guide part 13. Transfer takes place while the gearwheel 22 for supporting (and optionally driving) the chain 7 executes a half turn. The rod 23, in the retracted position in FIG. 3*a*, acts during the rotation of the gearwheel 22 on the element 20 which turns about its spindle 24 and (FIG. 3*b*) brings the mobile guide element 20 in front of the lower guide part 13 when the rod 23 is in extension.

The two systems represented in FIGS. 2 and 3 make it possible to save space, but it would also be possible to have a continuous rail which is followed by the rollers 9, 10, 15, 21. In this case, devices should, however, be provided in order to prevent, at the bottom left or at the top right, the carriage, driven by its weight at the end of travel, from leaving again in the direction from which it comes. This may, for example, be a chain which drives the rollers 15, 21, similar to the chains 7, 8.

Figure 4:
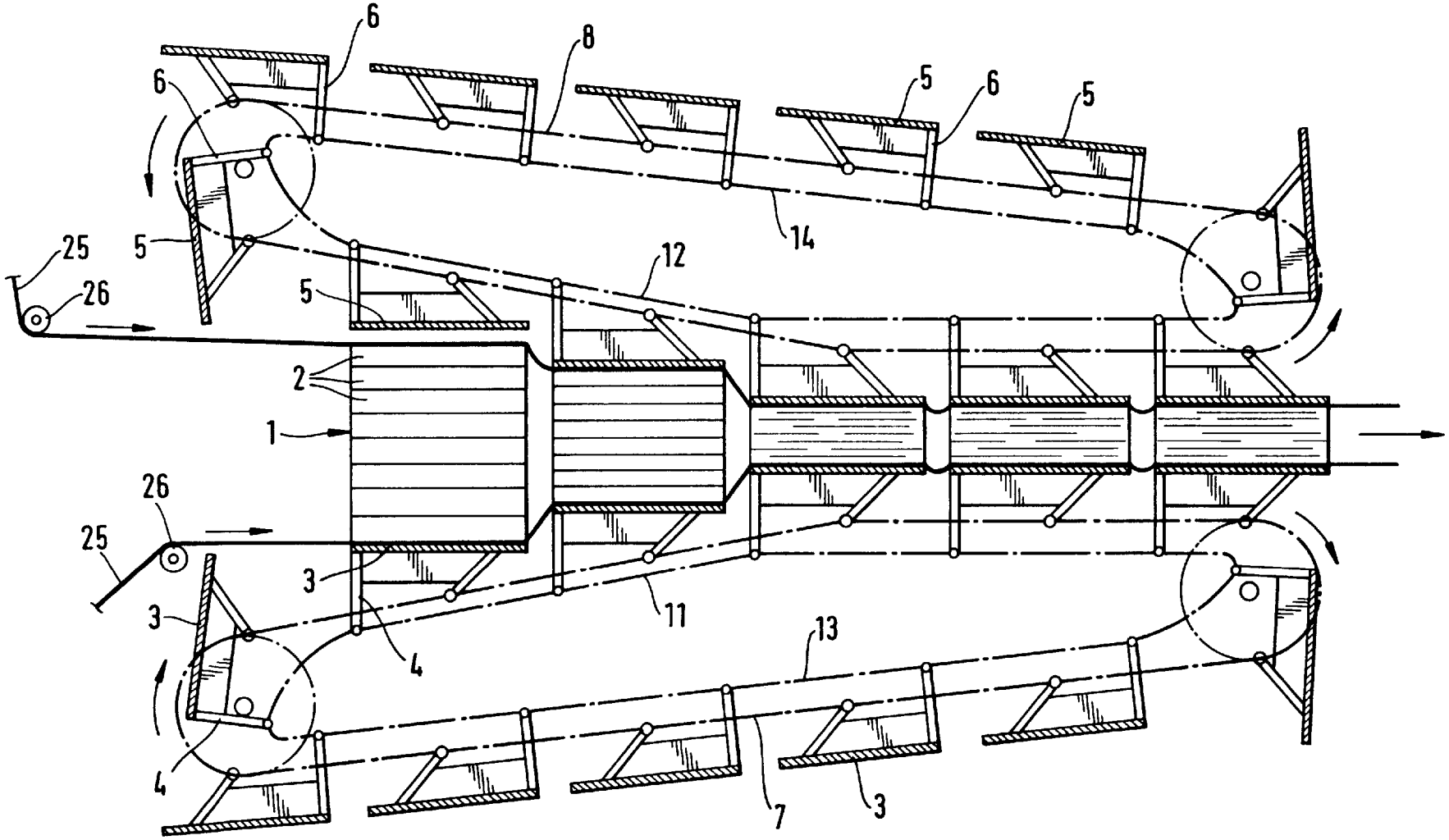
FIG. 4 shows a variant according to which the carriages move in the manner of the steps of an escalator.

FIG. 4 represents a variant of the system for driving the platens whose purpose is to transport and press the volumes of compressible materials. This traditional system, whose mechanism resembles that of escalators, has the drawback of requiring much more space for the return circuit. Moreover, at the moment when the platens are to move apart in order to release the compressed products, they cannot remain either horizontal or parallel, which does not facilitate handling of the finished products. Hybrid solutions are also possible, one of the faces of the stacks of panels being supported (or surmounted) by a plate associated with a carriage, whilst the other bears on a single synchronous conveyor belt so as to avoid slicing. However, in this case, the packaging process could not be the same as that described hereafter, but must be adapted.

The process according to the invention also includes an original packaging technique. It is applied in this case to a volume of compressed material, but it is also applicable to products whose density is not reduced when they are packaged. In the case of the compressed-compressible products of the invention, the packaging technique described hereafter, or an equivalent technique, is an indispensable complement of the compression method because it alone makes it possible to keep the volume virtually compressed, while limiting reexpansion as much as possible.

FIG. 1 and FIG. 4 represent a system for supplying packaging film 25. The film is fed from two rollers, not represented. It has a precise width which, during the tests, was equal for each of the films 25 to half the perimeter of the compressed volume, plus a few centimetres in order to allow overlap of the films each constituting half of the sheath which packages and encloses the compressed product.

The choice of two half-sheaths of identical width is arbitrary. It makes it possible to join the two films at the middle of the sides of the compressed volumes, but different widths or asymmetric positions could equally well have been chosen for the packaging films, and therefore differently placed joining locations.

The films 25 are guided by rollers 26 so as to come into contact respectively with the platens 3, 5 of the first carriages 4, 6. On the lower plate 3, the packaging film extends laterally beyond the products to be compressed (and, optionally, even beyond the platen 3 itself). At the top, the edges of the band are folded down on each side of the stack 1. The film 25 is preferably moved only by the movement of the carriages, which ensures that the film is longitudinally tensioned under and on the stack 1 of mats 2 of mineral fibres. In FIG. 1, the last carriages are in the compression region, the first two in the packaging region, where the length of film between the plates no longer varies, and the fifth, at the centre, in transition between the two regions.

Figure 5:
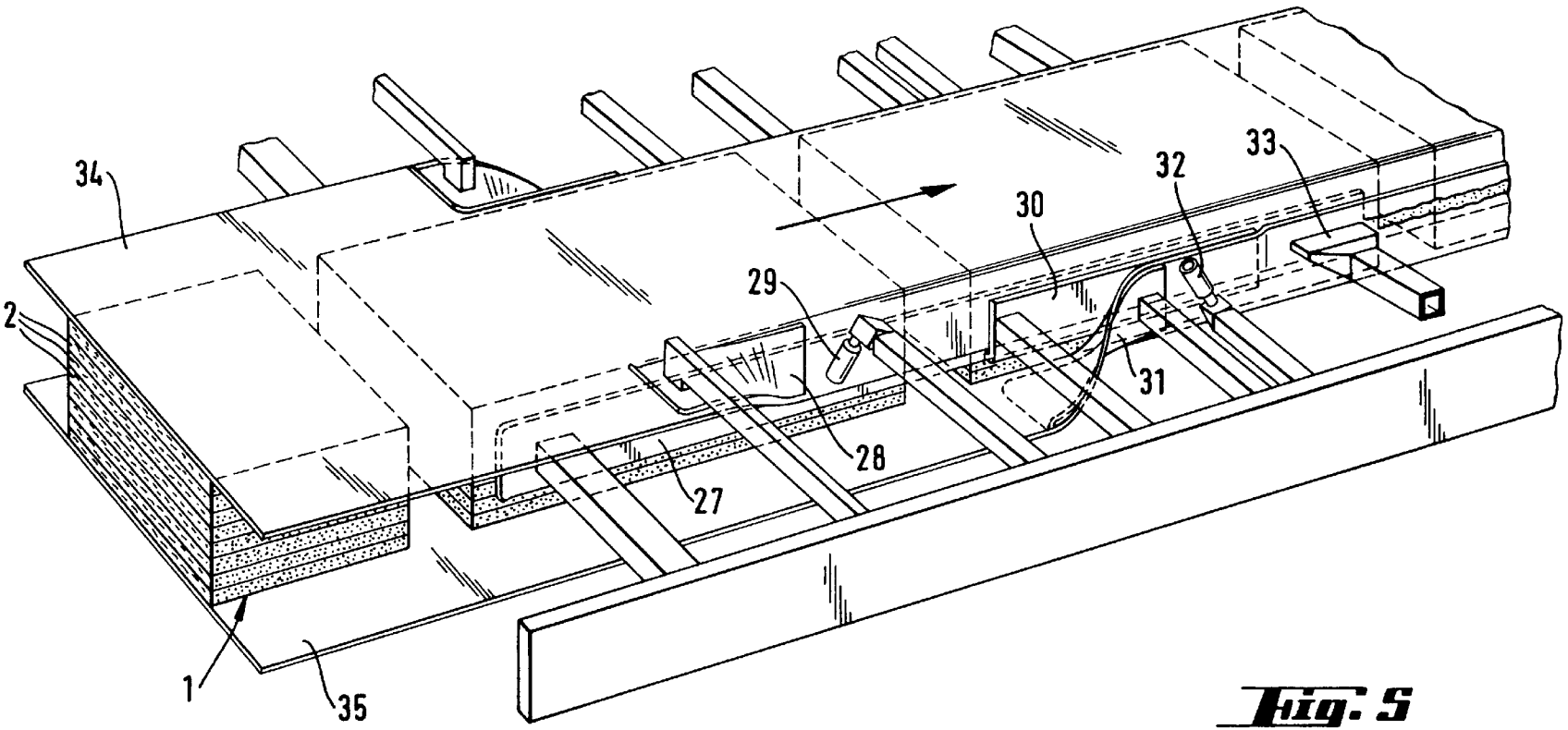
FIG. 5 represents the shapers of the edges of the bands of packaging film and a hot-air nozzle.

After the start of the packaging region, FIG. 5, shapers have been placed in the central region, on each side, the purpose of which is to position the edges of the bands of film 25. The figure shows a bearing plate 27 on which the upper film bears (externally) and which extends to just after the junction region. A shaper 28, a sort of metal plate of suitable shape, folds the border of the upper film 34, which a press roller 29 applies onto the bearing plate 27.

Symmetrically, the border of the lower film 35 is taken by the shaper 31 and guided along the bearing plate 30 (located at a defined distance from the bearing plate 27) where it is pressed by the roller 32. At the end of the plate 30, the upper and lower borders come into contact and they can be joined together. In order to do this, several means 33 are possible: supply of an external adhesive (in particular a hot melt), depositing a double-sided adhesive which will have been introduced at the upstream end of the plate 30 for bearing the lower film, or else autogenous welding of suitable plastic films. It is this technique which constitutes the preferred embodiment of the invention. The film is an HD (high-density) polyethylene film with a thickness of 50 to 100 $\mu$m (tests carried out with a low-density LD film also gave excellent results), the means for melting the material is heat supplied by nozzles which blow air at a temperature of between 400 and 650° C.; tests were carried out with air heaters of the company LEISTER. The person skilled in the art adapts the air temperature and blowing rate to the speed at which the film passes in front of the nozzles. Furthermore, safety systems cut off the hot air supply (or become it [sic]) if the line is stopped.

The packaging technique which has just been described in detail uses a technique of autogenous welding of a plastic film; the use of a different kind of packaging film or a different technique for joining the edges of the film would not depart from the scope of the invention.

Similarly, the means for assembling the borders of the two bands, upper and lower, which cross and overlap over a large area could be replaced by edge-to-edge joining, where the inner face of one film would be in contact with the inner face of the other. This technique is not preferred because it places the weld or bonded join under peeling stress, and this type of assembly is less secure than the one adopted, in which the join is subjected to shear stress.

The use of a strong film with high modulus, that is to say one which does not extend very much under loading, makes it possible to keep the volume of compressed materials, such as a stack of mineral fibre mats, to the minimum possible size which is little different from the size which it reached at the end of compression, the effect of release from the platens such as 3, 5 being simply a deformation of the perimeter of the sheath, which can be substantially rounded while increasing its thickness along the axis and thinning on its edges, while its area and therefore the volume of the compressed product increase slightly.

At the exit of the line, the packets of packaged materials 36 are moved by a conveyor 37. They are combined as a chain in the packaging sheath. Between two packets, the sheath is in the form of an empty skin 38. In one variant of the invention, provision was made to install at this point a known device which makes it possible to weld and/or cut the films automatically in order to separate the packets of packaged material and optionally protect them if the packaging is closed.

The tests carried out with the machine which has just been described for compressing and packaging mats of mineral wool were very positive.

A series of stacks of 8 glass wool mats with dimensions of 1200×600 mm was made, the thickness of the mats being 128 mm and their density 7 kg/m$^3$. The height of the stack before compression was measured at 1010 mm (slight compression under the effect of weight). The identical stacks followed one another in the normal fashion on the line.

With the vertically displaceable upper part of the machine having been placed in such a way that, at the end of the line, the platens are separated by 125 mm [sic]. The force exerted was measured, and it was 206 decanewtons.

The packaging film was a 60 $\mu$m thick HD polyethylene, the speed of advance of the line was 20 m/min. At the end of the cycle of compression, packaging, transverse welding and separation of the packets, the volume of the packets was measured. It was 112.5 litres which corresponds to a compression ratio of the order of 6.5. On release from its wrapping, the stack of products returned to a height of 950 mm, which corresponds to an acceptable thickness loss per panel.

A second series of tests was carried out. These involved compressing and packaging glass wool panels with a dimension of 1350×600 mm with a nominal thickness of 100 mm (108 mm actual thickness). Their density was 13.75 kg/m$^3$.

Stacks of 7, 9, 11 and 15 panels where successively made, and each stack was compressed more than the preceding one. The table below presents the results.

| Number of panels | 7 | 9 | 11 | 15 |
|---|---|---|---|---|
| Thickness of the stack (mm) | 740 | 945 | 1145 | 1545 |
| Final distance between plates (mm) | 160 | 169 | 166 | 200 |
| Maximum compression | 4.6/1 | 5.6/1 | 6.9/1 | 7.5/1 |
| Overall thickness of the packaged packet (mm) | 318 | 320 | 325 | 350 |
| Compression ratio | 3.1/1 | 3.9/1 | 4.7/1 | 5.6/1 |

At the end of the operation, after the sheath had been torn, the released panels returned to their nominal thickness, 100 mm.

The compression and packaging method in the above tests thus makes it possible to provide a packaged product whose compression ratio is the maximum which it is possible to retain when a deformable sheath is used as the packaging.

The techniques of the invention which have just been described thus make it possible easily to package volumes of compressible materials, and, in particular, stacks or rolls of mineral wool. In contrast to the processes of the prior art, the packaging takes place continuously and the compression which is exerted simultaneously and symmetrically on the volume avoids damage due to shearing of the material and makes it possible to operate more rapidly with smaller forces.

We claim:

1. Process for packaging a volume of compressible material, comprising:

supporting a volume of compressible material on a pressing plate of a first carriage in a first train of carriages, there being a second train of carriages positioned above said first train of carriages such that a pressing plate of a second carriage of said second train of carriages extends parallel to said pressing plate of said first carriage and is positioned directly above said first carriage;

moving said first and second trains of carriages in a horizontal conveying direction and at the same speed; and simultaneous with said moving step, drawing said pressing plates of said first and second carriages symmetrically toward one another in a pressing direction transverse to the conveying direction, while maintaining said pressing plates of said first and second carriages parallel to one another, so as to compress the volume of material between the plates of said first and second carriages.

2. The process of claim 1, further comprising the step of wrapping the volume of compressed material in a sheath which limits the expansion of the compressed material.

3. The process of claim 2, wherein the sheath comprises two bands of packaging film respectively positioned above and below the volume of material, each band having a width sufficient to permit the bands to overlap at sides of the compressed volume of material, further comprising:

moving the bands in the conveying direction with the volume of material being compressed; and joining the bands at the sides of the compressed volume of material.

4. The process of claim 3, wherein the packaging film is a plastic film and the joining step comprises welding the bands, further comprising the step of testing the weld.

5. The process of claim 1, wherein the volume of material comprises a panel of mineral wool.

6. The process of claim 1, wherein the volume of material comprises a panel of glass wool.

7. Device for packaging a volume of compressible material, comprising:

a first train of carriages having first carriages, each including a pressing plate for supporting a volume of compressible material;

a second train of carriages having second carriages positioned above, and in correspondence with, the first carriages of said first train of carriages such that a pressing plate of each of said second carriages of said second train of carriages extends parallel to said pressing plate of a corresponding first carriage and is positioned directly above said pressing plate of said corresponding first carriage;

a device for moving said first and second trains of carriages in a horizontal conveying direction and at the same speed; and a device for vertically drawing said pressing plates of said first and second carriages symmetrically toward one another in a pressing direction transverse to the conveying direction, simultaneous with said moving of the trains of carriages in the conveying direction, while maintaining said pressing plates of said first and second carriages parallel to one another, so as to compress the volume of material between the pressing plates of said first and second carriages.

8. Device according to claim 7, characterized in that it includes, associated with each train, a dispenser of a band of plastic film arranged so as to bring one band into contact with the plate of a first lower carriage and another into contact with that of a first upper carriage, and in that the bands of plastic film have a width allowing them to be superposed on the sides of the volumes of compressed material.

9. Device according to claim 7, characterized in that the trains include, downstream, a region where the separation between corresponding plates is substantially invariant.

10. The device of claim 7, further comprising a device for maintaining a fixed spacing between said pressing plates of said first and second carriages while moving of the trains of carriages in the conveying direction.

11. The device of claim 7, wherein the device for moving said first and second trains of carriages in a horizontal conveying direction and at the same speed comprises a chain conveyor, and a two directional guide.

12. The device of claim 7, wherein the device for moving said first and second trains of carriages in a horizontal conveying direction and at the same speed comprises a chain conveyor, and a movable guide.

13. The device of claim 7, further comprising at least one sheathing material dispenser positioned so as to dispense sheathing material onto the pressing plates of said first and second carriages.

14. The device of claim 13, further comprising shaping elements positioned to place the sheathing material against the sides of the volume of compressed material.

15. The device of claim 14, further comprising a device positioned to weld the placed sheathing material.

16. The device of claim 13, further comprising a cutter positioned downstream of the trains of carriages for cutting the sheathing material between successive volumes of the material.

17. The device of claim 13, further comprising a welder positioned downstream of the trains of carriages for welding the sheathing material between successive volumes of the material.

* * * * *